United States Patent [19]

Berg et al.

[11] 4,410,790

[45] Oct. 18, 1983

[54] HEATED AUTOMOBILE MIRROR

[75] Inventors: Peter G. Berg, Attleboro Falls, Mass.; Stephen J. Strobel, Providence, R.I.

[73] Assignee: Texas Instruments Incorporated, Dallas, Tex.

[21] Appl. No.: 328,322

[22] Filed: Dec. 17, 1981

[51] Int. Cl.[3] ..... H05B 1/00

[52] U.S. Cl. ..... 219/219; 219/203; 219/505; 219/522; 219/541; 338/22 R; 350/582

[58] Field of Search ..... 219/202, 203, 219, 505, 219/522, 530, 541, 553; 338/22 R; 350/61

[56] References Cited

U.S. PATENT DOCUMENTS

| | | | |
|---|---|---|---|
| 2,564,836 | 8/1951 | Elsenheimer | 219/219 |
| 2,565,256 | 8/1951 | Myers et al. | 219/219 |
| 3,052,787 | 9/1962 | Williams | 219/219 |
| 3,940,822 | 3/1976 | Emerick et al. | 219/219 X |
| 3,976,854 | 8/1976 | Ishikawa et al. | 219/505 |
| 3,996,447 | 12/1976 | Bouffard et al. | 219/541 |
| 4,237,366 | 12/1980 | Berg | 219/219 |
| 4,283,117 | 8/1981 | Ellis | 350/61 X |

*Primary Examiner*—Volodymyr Y. Mayewsky
*Attorney, Agent, or Firm*—James P. McAndrews; John A. Haug; Melvin Sharp

[57] ABSTRACT

An economical mirror unit adapted for exterior mounting on an automobile has a single self-regulating electrical resistance heater disc of a material of positive temperature coefficient of resistivity mounted in a recess on a heat-distributing metal plate and enclosed in the recess by a glass reflecting member mounted over the recess so that the heater serves to defog the reflecting surface of the member. Various portions of the plate have selected different spacings from the glass reflecting member for heating various overlying portions of the reflecting member to a substantially uniform temperature so that the heater is operable at a high temperature to rapidly and uniformly defog the mirror without risk of damage to the glass reflecting member.

6 Claims, 2 Drawing Figures

HEATED AUTOMOBILE MIRROR

BACKGROUND OF THE INVENTION

The field of this invention is that of defogging mirror units and the invention relates more particularly to a defogging automobile mirror using an electrical resistance heater for defogging the mirror.

Mirror units intended for use on the exterior of automobiles have been provided with self-regulating electrical resistance heaters of materials of positive temperature coefficient of resistivity. The heaters are electrically energized when automobile operation is started for heating the glass-reflecting members of the mirror units so that the reflecting members are defogged. In a particularly advantageous defogging mirror unit of this type as shown in U.S. Pat. No. 4,237,366 commonly assigned to the assignee of the present invention, a self-regulating electrical resistance heater is mounted on a thermally and electrically conducting metal plate in a recess formed in the plate and a glass reflecting member having a reflecting surface formed thereon is mounted on the plate over the recess for enclosing the heater in the recess. In that arrangement, the heater is economically enclosed in the mirror unit to be conveniently connected in an electrical circuit for defogging the mirror.

However, it is found that when such electrical resistance heaters of positive temperature coefficient of resistance are energized, they initially provide a very substantial heat output. Then, they rapidly self heat and increase in resistance so that the heater current and heat output from the heater are reduced until the heater stabilizes at a self-regulated temperature at which the amount of heat generated by the heater is balanced by the amount of heat being dissipated from the heater. When such heaters are used for heating glass-reflecting members in a defogging mirror unit or the like, it is found they tend not to provide uniform heating to all portions of the mirror unit. Accordingly, there is some tendency to provide less than complete mirror defogging particularly under certain ambient temperature conditions and when the heater has been operating for a time in its stabilized, self-regulated, low heat output heating mode. On the other hand, if the heater is provided with a relatively higher operating temperature in attempting to overcome the incomplete mirror defogging, there is some risk of injury to the glass reflecting member due to the development of hot spots in the member.

It is an object of this invention to provide a novel and improved heated mirror unit; to provide a defogging mirror unit which is adapted to provide substantially uniform defogging of all portions of the unit in the various weather conditions likely to be encountered during operation of an automobile; to provide such mirror unit which is adapted to be operated under such varying weather conditions without risk of injury to the mirror unit; and to provide such an improved mirror unit which is of rugged and economical construction.

SUMMARY OF THE INVENTION

Briefly described, the novel and improved defogging mirror unit of this invention comprises a plate of thermally and electrically conductive metal material or the like. The plate is formed to provide a recess in the plate at one side of the plate. An electrical resistance heater of a material of positive temperature coefficient of resistivity is mounted in the plate recess with one side of the heater in electrically and thermally conducting relation to the plate and contact means are arranged for electrically connecting the other side of the heater to a power source such as the battery power source of an automotive engine or the like for energizing the heater. The heater is adapted to self-heat and stabilize at a self-regulated heater temperature in conventional manner. A glass reflecting member is disposed over the plate recess for enclosing the heater in the recess.

In accordance with this invention, a first part of the thermally and electrically conductive plate mounts the heater thereon and forms a central bottom portion of the plate recess. That first plate part has a spacing relative to an overlying portion of the glass member which is selected so that the overlying glass member portion is rapidly heated and maintained at a desirable defogging temperature without risk of injury due to overheating or the like under the various weather conditions likely to be encountered in automobile operation. In accordance with this invention, at least one additional part of the plate forms an additional bottom portion of the plate recess which surrounds the central bottom portion of the plate recess. The additional plate part has a relatively lesser spacing from a corresponding overlying portion of the glass reflecting member and the spacing of that additional plate part from the overlying glass member is also selected for heating the corresponding portion of the glass member to a corresponding defogging temperature. Other peripheral parts of the plate which mount marginal portions of the glass reflecting member thereon are disposed with still lesser spacings from the overlying marginal portions of the glass reflecting member so that the marginal portions of the member are also heated to a corresponding desired defogging temperature. In that way, the heater provides substantially uniform defogging heating of the various portions of the glass reflecting member and the self-regulating operating temperature of the heater is selected to achieve desired speed and uniformity of defogging without risk of injury to the glass member.

If desired, where the mirror unit has support means connected to the metal plate for mounting the mirror unit on an automobile and where such support means result in variation of heat transfer from the plate to the glass reflecting member, corresponding portions of the plate are provided with selected spacings from the glass reflecting member to cooperate with the heat-dissipating effect of the support means in achieving heating of all portions of the reflecting member to substantially uniform defogging temperature as will be understood.

DESCRIPTION OF THE DRAWINGS

Other objects, advantages and details of the novel and improved defogging mirror unit of this invention appear in the following detailed description preferred embodiments of the invention, the detailed description referring to the drawings in which.

DESCRIPTION OF THE PREFERRED EMBODIMENTS

Figure 1:
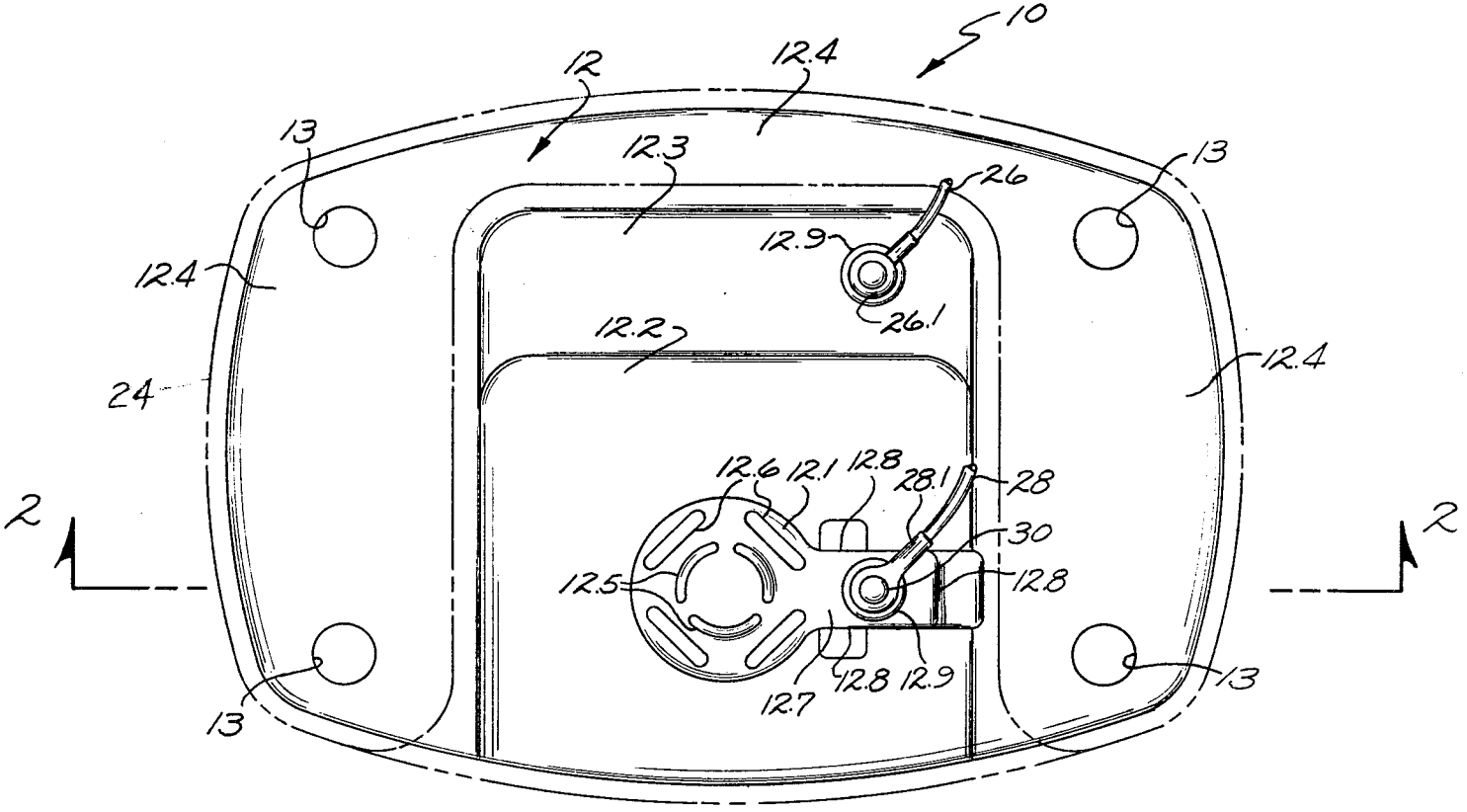
FIG. 1 is a plan view of the heated mirror unit of this invention illustrating the unit with support means for the unit diagrammatically indicated by broken lines.
Figure 2:
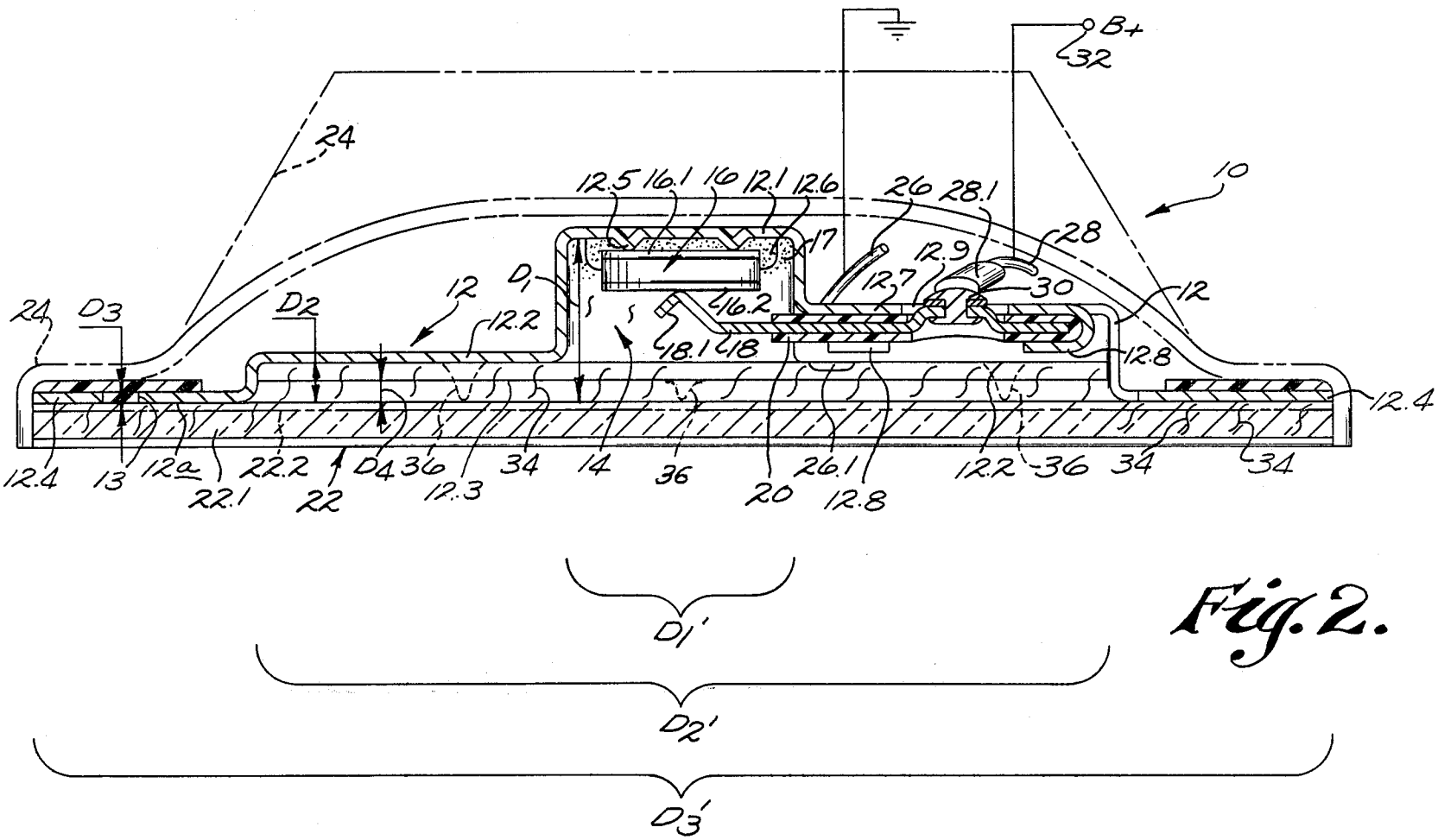
FIG. 2 is a section view to enlarged scale along line 2—2 of FIG. 1.

Referring to the drawings, 10 in FIGS. 1 and 2 indicates the novel and improved heated defogging mirror unit of this invention which is shown to include an electrically and thermally conducting heat-distributing metal plate 12 preferably formed of an inexpensive, light weight, and readily formable material such as aluminum. Preferably the plate is of generally flat configuration as indicated and in accordance with this invention, the plate is formed to provide a recess or well 14 in the plate to be accessible from one side 12*a* of the plate.

In accordance with this invention, the plate 12 is formed so that a first part 12.1 of the plate forms the central bottom portion of the recess 14. The plate also has at least one additional part 12.2 of the plate forming an additional bottom portion of the recess surrounding the central bottom portion 12.1 of the recess at a different level in the recess. In one preferred embodiment of this invention, the plate 12 also has another part 12.3 formed to provide another bottom portion of the recess 14 at yet another different level in the recess for a purpose to be described below and the plate has peripheral portions 12.4 which are disposed around the recess 14 as shown in FIGS. 1 and 2. In the preferred embodiment of this invention, the first part 12.1 of the plate 12 is formed to provide contact portions or dimples 12.5 which stand up into the recess 14 from the central bottom portion of the recess. In addition, the first plate part 12.1 is preferably provided with heater locater portions or ridges 12.6 which stand up into the recess 14 from the central bottom portion of the plate in generally surrounding relation to the contact portions 12.5 formed in the plate.

In a preferred embodiment of this invention, a part 12.7 of the plate 12 is also formed to provide a portion of the recess 14 which extends laterally from the central bottom portion of the recess in communication with the central bottom portion of the recess. The plate has tabs 12.8 which are struck from the plate to extend into that laterally extended portion of the recess as described below. Preferably, apertures 12.9 are formed in the plate parts 12.3 and 12.7 respectively. Preferably, mounting apertures 13 are also provided in the peripheral parts 12.4 of the plate.

In accordance with this invention, a heater body or disc 16 of a ceramic electrical resistance material or the like having a positive temperature coefficient of resistivity (PTC) is disposed in the recess 14 with one side of the heater disc in electrically and thermally conducting relation to the plate 12. Preferably, the heater disc is formed of a doped barium titanate ceramic material or the like and is adapted to display a sharp, anomolous increase in resistivity when heated to a selected temperature so that the heater self-heats and stabilizes at a self-regulated operating temperature of about 150° C. when the heater is electrically energized. The heater disc is provided with metal contact coatings 16.1 and 16.2 on opposite sides of the heater disc for making electrical contact to the ceramic resistance material of the disc.

In accordance with this invention, the heater disc 16 is typically provided in a square configuration and is disposed in the recess 14 so that one side 16.1 of the heater is electrically and thermally engaged with the contact points 12.5 of the first part 12.1 of the electrically and thermally conductive plate 12 and is prevented from moving laterally off the contact points 12.5 by the locater ridges 12.6 formed in the plate. If desired, the spaces between the side 16.1 of the heater and the first plate part 12.1 are filled with thermally conducting silicone grease or the like as indicated at 17 by stippling in FIG. 2 to facilitate heat transfer from the heater 16 to the first plate part 12.1.

In accordance with this invention, an electrical contact means such as an electrically conductive spring blade 18 is partially enclosed in a sleeve 20 of an electrically insulating material such as Mylar or the like which is preferably heat-shrunk onto the blade. The blade is provided with a plurality of contact fingers as indicated at 18.1 in FIG. 2 and is disposed in the laterally extending part of the recess 14 to fit against the plate part 12.7 so that the plate tabs 12.8 are folded around the blade to secure the blade to the plate 12 to be electrically insulated from the plate by the insulating sleeve 20 and so that the contact fingers 18.1 electrically engage the opposite side 16.2 of the heater and resiliently hold the heater against the plate contacts 12.5.

A glass reflecting member 22 is mounted on the plate 12 over the recess 14 so that the heater 16 and the spring blade 18 are enclosed in the recess. Preferably, for example, the member 22 includes a glass plate 22.1 having a silvered reflecting surface coated thereon in conventional manner as is diagrammatically indicated by the broken line 22.2 in FIG. 2. Typically, the glass reflecting member is secured to the plate 12 and is also mounted in a metal support housing or the like as is diagrammatically illustrated by the broken lines 24 in FIGS. 1 and 2 by the use of a cement 25 or the like which fits through the plate apertures 13 to cement the reflecting member to the plate and to cement the plate to the support means 24.

In the preferred embodiment of this invention, a wire lead 26 having a clinched terminal 26.1 is fitted into one of the plate apertures 12.9 and is clinched to the plate therein for electrically connecting the plate to electrical ground as is indicated in FIG. 2. A wire lead 28 having a similar terminal 28.1 is fitted through the additional plate aperture 12.9 in electrically insulated relation to the plate 12 and is riveted as at 30 or otherwise electrically connected to the spring blade 18 for electrically connecting the heater 16 to an automotive power source such as the battery or the like as is indicated at 32 at FIG. 2.

In that arrangement, one side 16.2 of the heater is electrically connected from the power source 32 through the wire lead 28 and the spring blade 18 and the other side 16.1 of the heater is connected to electrical ground through the plate 12 and the lead 26. When the heater is energized, it generates heat for defogging the glass reflecting member 22. The plate 12 distributes heat to the glass reflecting member as indicated by the waving lines 34 in FIG. 2. In accordance with this invention, the first plate part 12.1 mounting the heater thereon is spaced at a distance $D_1$ from the glass reflecting member 22 so that the overlying portion $D'_1$ of the glass reflecting member is heated to a desirable defogging temperature. An additional plate part 12.2 is spaced at a lesser distance $D_2$ from the glass member, and the peripheral plate parts 12.4 mount the glass member at a relatively lesser spacing from the member 22 or are even directly engaged with the member as indicated at $D_3$ in FIG. 2, those spacings being selected so that they distribute heat to corresponding overlying portions $D'_2$ and $D'_3$ of the glass reflecting member for heating those portions of the reflecting member to corresponding defogging temperatures, thereby to heat the various portions of the member to substantially uniform defogging temperature. If the support means 24 tends to withdraw heat from a plate part 12.3 or the like at a rate different from the rate at which heat is dissipated from other portions of the plate 12, the spacing $D_4$ of the plate part 12.3 from the glass reflecting member is selected to compensate for that difference to assure that uniform defogging heating of the reflecting member is achieved. In that regard, it is found that spacing of the plate part 12.1 at a distance of about 0.075 inches from the member 22 permits the noted relatively high operating temperature of the heater to be used without risk of injury to the glass reflecting member while a spacing $D_2$ of about 0.015 inches and a spacing $D_3$ of 0.000 inches achieves relatively uniform heating of the member 22 at a defogging temperature suitable for the range of temperatures likely to be encountered in use of an automobile. A spacing $D_4$ of about 0.010 inches from the member 22 compensates for the relatively lesser heat dissipation likely to occur at the rear of the plate 12 where the metal support means 24 has a configuration such as that indicated in FIG. 1. In that way, the mirror unit 10 has a rugged low cost structure and is adapted to permit rapid and uniform defogging of the mirror unit under different environmental conditions without risk of injury to the glass reflecting member 22.

If desired, the plate parts 12.2 and 12.3 are provided with dimples as indicated by broken lines 36 to assist in spacing the glass reflector 22 from the plate 12.

In an alternate embodiment, where a larger glass reflector is used, the plate is provided with a plurality of recesses and the plate has a plurality of first parts forming central bottom portions of the respective recesses having selected spacing from the reflector and mounting respective heaters thereon and having a plurality of additional plate parts surrounding the respective recesses having relatively lesser spacings from the reflector.

It should be understood that although preferred embodiments of this invention have been described by way of illustrating the invention, this invention includes all modifications and equivalents of the disclosed embodiments falling within the scope of the appended claims.

We claim:

1. A defogging mirror unit comprises a plate of thermally and electrically conductive metal material formed to provide a recess at one side of the plate, a self-regulating electrical resistance heater of a material of positive temperature coefficient of resistivity having one side mounted in electrically and thermally conducting relation to said one side of the plate inside the recess, contact means for electrically connecting the other side of the heater to a power source for energizing the heater to self-heat and stabilize at a relatively high self-regulated heater temperature, and a glass reflecting member disposed over the plate recess enclosing the heater in the recess so that heat from the heater is distributed to the glass reflecting member for defogging the member, characterized in that, a first part of the plate mounts the heater thereon and forms a central bottom portion of the recess having a first selected spacing from the glass reflecting member for heating a portion of the member overlying the first plate part to a selected temperature, at least one additional plate part forms at least one additional recessed bottom portion surrounding the central recess bottom portion having relatively lesser spacing from the glass reflecting member for heating portions of the member overlying each said additional plate part to corresponding temperature, and peripheral parts of the plate disposed around said additional plate part mount marginal portions of the glass reflecting member thereon and have relatively lesser spacing from the member than the additional plate part for heating said marginal portions of the member to corresponding temperature, whereby heat is distributed to the member for heating said various portions of the member to a substantially uniform temperature.

2. A mirror unit as set forth in claim 1 further characterized in that the reflecting member comprises a glass member having a reflecting surface formed thereon, and the heater self-regulates at a relatively high heater temperature, the spacing of the first plate part from the member being selected to maximize defogging temperature of the member while avoiding injury to the glass reflecting member under ambient temperature conditions likely to be encountered in automobile operation.

3. A mirror unit as set forth in claim 2 having metal support means for mounting the mirror unit, the plate having selected plate parts which are associated with said metal support means and which have selected spacing from the glass reflecting member for cooperating with the heat-conducting properties of the support means to heat said various portions of the reflecting glass member to said substantially uniform temperature.

4. A mirror unit as set forth in claim 3 wherein the heater comprises a disc of ceramic material having electrical contact coatings formed on opposite sides thereof, the first plate part has contact portions formed thereon standing up from the first plate part to electrically engage the metal contact coating at one side of the heater, and said contact means include a spring contact blade secured to said one side of the plate to extend over the recess to electrically engage the other side of the heater for energizing the heater, the spring contact blade having a heat-shrunk sleeve thereon electrically insulating the blade from the support.

5. A mirror unit as set forth in claim 4 wherein the first plate part has heater retaining portions formed therein standing up from the first plate part in surrounding relation to said contact portions of the plate, the heater is disposed in engagement with said contact portions surrounded by said retaining portions, and the spring contact blade resiliently bears against the other side of the heater for retaining the heater in engagement with the plate contact points.

6. A mirror unit as set forth in claim 2 wherein the plate has a plurality of first parts mounting respective heaters thereon forming central bottom portions of respective recesses having selected springs from the reflector member and has a plurality of additional plate parts surrounding the respective central bottom portions having relatively lesser spacing from the reflector.

* * * * *